US006040522A

United States Patent [19]

Beggs

[11] Patent Number: 6,040,522

[45] Date of Patent: Mar. 21, 2000

[54] ELECTRICALLY GROUNDED LAND SURFACE MOUNTING FOR ELECTRICAL EQUIPMENT

[76] Inventor: William C. Beggs, 4110 Shawanee La., NE., Atlanta, Ga. 30319

[21] Appl. No.: 09/061,554

[22] Filed: Apr. 16, 1998

[51] Int. Cl.[7] ..... H01R 4/66

[52] U.S. Cl. ..... 174/7; 362/431; 174/5 SG

[58] Field of Search ..... 174/2, 6, 7, 5 SG, 174/5 R, 45 R, 48; 362/145, 153.1, 431, 470

[56] References Cited

U.S. PATENT DOCUMENTS

| | | | |
|---|---|---|---|
| 3,566,000 | 2/1971 | Maurer et al. | 174/7 |
| 3,755,977 | 9/1973 | Lewis | 52/98 |
| 3,876,819 | 4/1975 | Boyd et al. | 174/7 |
| 4,255,608 | 3/1981 | Bosch et al. | 174/5 R |
| 4,302,799 | 11/1981 | Behrens | 362/226 |
| 4,373,111 | 2/1983 | Myers et al. | 174/48 |
| 4,467,575 | 8/1984 | Dziedzic | 52/157 |
| 4,688,969 | 8/1987 | Bruser et al. | 405/303 |
| 4,707,964 | 11/1987 | Hoyt et al. | 52/742 |
| 5,801,327 | 9/1998 | Tobias | 174/6 |
| 5,954,426 | 9/1999 | Whittington | 362/414 |

*Primary Examiner*—Kristine Kincaid
*Assistant Examiner*—W. David Walkenhorst
*Attorney, Agent, or Firm*—Lee, Mann, Smith, McWilliams, Sweeney & Ohlson

[57] ABSTRACT

An electrically grounded land surface mounting for an electrical fixture such as an airport runway approach light is disclosed. A flanged member connects a frangible coupling to a long, straight steel rod driven into the ground at the site. The coupling accepts a post supporting the light and can be broken if an aircraft wing or tire should strike it. The flanged member is adjustably clamped onto a first end of the rod extending above the surface of the ground at the site, and the remainder of the rod is buried in the ground at the site to discharge any electrical charge in the fixture or in the atmosphere around the fixture in accordance with the National Electrical Code or other grounding requirements.

16 Claims, 5 Drawing Sheets

60
58
56
56
12
54
40
10
36a
44
62
52c
16
26
36c
28
28a
20
18
48c
28c
14
2
2
24
34
32
22
30
3
3
52
50
48
28b
36
36b
46

36a
38
28a
42
42
38a 36b
48
50
28b

ELECTRICALLY GROUNDED LAND SURFACE MOUNTING FOR ELECTRICAL EQUIPMENT

This invention relates to an electrically grounded land surface mounting for an electrical fixture which is particularly adapted for installation in an earthen site at an airport or similar open area. More particularly it relates to an electrical fixture, such as an airport runway approach light, or an edge light along an airport runway, or other directional light or sign along the side of a taxiway, mounted upon a base which is connected to and fastened in place by one or more electrical ground rods driven into the earth at the site.

Various foundations utilizing earth anchors have been developed for supporting a variety of structures. Some have been devised for towers supporting electrical transmission lines, one example of which is illustrated in U.S. Pat. No. 4,707,964. The tower supports shown in that patent have elongated shafts with outwardly extending load bearing elements affixed to each shaft, (i.e., helical blades). The patent notes that simply installing screw anchors into the earth and attaching tower legs thereto has been proven to be impractical for a number of reasons and adds its own embellishment onto the blade-bearing shaft. Another earth anchor is illustrated in U.S. Pat. No. 4,467,575, which again incorporates an annular outstanding flange or helical blade. Still another form of rod having an auger blade on the portion of the rod buried in the ground is shown in U.S. Pat. No. 4,255,608. See also the variety of anchors in the July 1997 catalog of AB. Chance Co., July 1997 which have auger blades.

Auger type shafts are difficult to drive into the ground. They require a high amount of torque to drive them, and a substantial amount of material strength is needed in order to avoid shearing or other breakage. Usually they must be driven into the ground independently and then adjusted to fit the structure which they support. If driven to any appreciable depth, the apparatus used to drive them requires a power source which often has substantial weight.

The present invention combines a mechanical mounting for an electrical fixture with the ease of installing it on a straight rod having substantially smooth sides. The rod is easily driven into the earth at a site with hand tools, and it accomplishes electrical grounding which satisfies all electrical codes. The present invention also combines strength and ease of handling in a small supporting bracket for an electrical fixture. The bracket can be fastened to the rod at a point very low to the ground almost anywhere on an airfield that the straight ground rod can be driven.

In the United States the National Electrical Code defines a grounding electrode rod as a rod five-eighths inches in diameter which must have eight feet (2.44 m) of length in contact with the soil, or as a metallic plate which must have at least two square feet (0.186 S.M.) of area in contact with the soil. Another jurisdiction can require more or less rod length or plate area which can be satisfied by simply changing the length or plate area to be underground and attached rigidly to the structure. Paragraph 250-83 of the 1996 National Electrical Code also permits more than one electrode to be used in the same grounding system; when they are "effectively bonded together [they] shall be considered a single electrode system." The Code confirms "where practical, made electrodes shall be embedded below permanent moisture level".

Light fixtures, signs, antennas, and control and distribution fixtures are often mounted outdoors more than 6 feet (2 m) from a larger building and therefore require a separate grounding system to protect themselves and nearby persons from the effects of lightning discharges, power systems faults and other electrical and electromagnetic activities. Where protection is required on an airport a ground rod is driven 6 feet (2 m) or less from the device to be protected and a length of A.G. #6 wire is connected between the rod and the device. The device itself is often mounted on a Portland cement concrete base which extends below the frost line for all-weather stability, preventing the device from tilting after installation to maintain the desired beam angles of the lights or antennas or reflectors, and maintaining the desired moisture drainage from the fixtures. For mechanical safety on airports and alongside highways a mechanically frangible breakaway support coupling is located on the base which is mechanically attached to the ground. The frangible coupling is below the level of a vehicle sliding along the ground so that the sliding vehicle will break off the coupling on impact rather than suffer more severe damage to the vehicle and its occupants. The mechanical attachment of the base to the ground must be sufficient to assure the breaking of the coupling on prescribed impact. The lower portion of the typical 2" to 6" (0.5 m to 0.15 m) tall frangible coupling has a tapered male thread for 1½" IPS (~0.04 m IPS) to conveniently screw into the base. The upper portion accepts 2" EMT conduit or, in other versions, has a 1½" IPS female thread.

The present invention satisfies all of the foregoing requirements for sturdily mounting a frangible coupling in such a manner as to hold the described fixtures in a secure and safe manner.

Additionally, the present invention provides a means for holding a lightning rod in place for transmitting an electrical charge from a cloud to the ground, or vice versa. Such transmissions usually occur as an electrical charge builds up, i.e., before a lightning bolt can be generated, thereby avoiding the high intensity of electrical energy which a lightning bolt carries. However, even when an electrical charge does build up, a lightning rod which is held adjacent to an electrical fixture as in this invention transmits the energy of a lightning bolt into the ground quite readily and in so doing protects both the fixture and the nearby area from the bolt.

When a number of fixtures are utilized at an airport, the incidence of lightning strikes in that vicinity can be greatly reduced if many fixtures, such as edge lights along the runways, are all provided with lightning rods in accordance with the present invention. The number of lightning rods gathered in one vicinity provides a means for draining the electrical charge which may be built up in the atmosphere around the airport and allowing that atmosphere to continue its full insulative function.

A further advantage of the present invention is its ease of installation while still being a highly stable platform for an electrical fixture. The ground rods may be driven straight down into the ground, or at an angle, while still leaving the top end portion of each rod perfectly erect enough to hold the fixture base in a horizontal position. No concrete is required, and the expense and time required for digging out for a concrete form, obtaining and pouring the concrete, and giving a poured concrete block time to set are eliminated. The likelihood of movement of a concrete block due to freezing and thawing is also eliminated as the depth of the grounding rods in the earth holds the flanges of the fixture base firmly in position despite any earth movement near the surface.

SUMMARY OF THE INVENTION

In the present invention there is a base for mounting and grounding an electrical fixture in an earthen site which comprises at least one collar member having a first end adapted to receive support means for an electrical fixture, a flange member engaging the collar member and supporting the first end of the collar member in an upright position, and at least one elongated ground rod dowel member having a first end portion, a body portion and a second end portion, the first end portion being joined to the collar member by the flange member, and the second end portion and the body portion being positioned deeply within the earth at the site for transmitting and discharging electrical charges from the fixture and support means into the earth.

An object of this invention is to provide a foundation for supporting an electrical fixture at an earthen site which can be put down in place rapidly, usually within the abilities of the maintenance personnel already on the staff of the facility where the fixture is to be installed.

Another object of this invention is to provide a foundation for supporting an electrical fixture at an earthen site which is composed of light-weight parts which are easily assembled and readily portable.

A further object of this invention is to provide a foundation for supporting an electrical fixture at an earthen site which can incorporate a frangible coupling intermediate the fixture and the foundation in a firm connection which permits the coupling to break, and the fixture to fall when it receives only a low grade impact above the coupling.

A further object of this invention is to provide a foundation for supporting an electrical fixture at an earthen site which incorporates electrical grounding rods sufficiently driven into the earth to meet the requirements for grounding in the National Electrical Code.

A further object of this invention is to provide a foundation for supporting an electrical fixture at an earthen site which incorporates connections to electrical grounding rods which are readily adjustable for maintaining the fixture at an acceptable horizontal attitude.

These and yet additional objects and features of the invention will become apparent from the following detailed discussion of exemplary embodiments, and from the drawings and appended claims.

BRIEF DESCRIPTION OF THE DRAWINGS

For a complete understanding of this invention, reference should be made to the accompanying drawings in which.

DETAILED DESCRIPTION OF THE PREFERRED EMBODIMENTS

Figures 1, 2, 3:
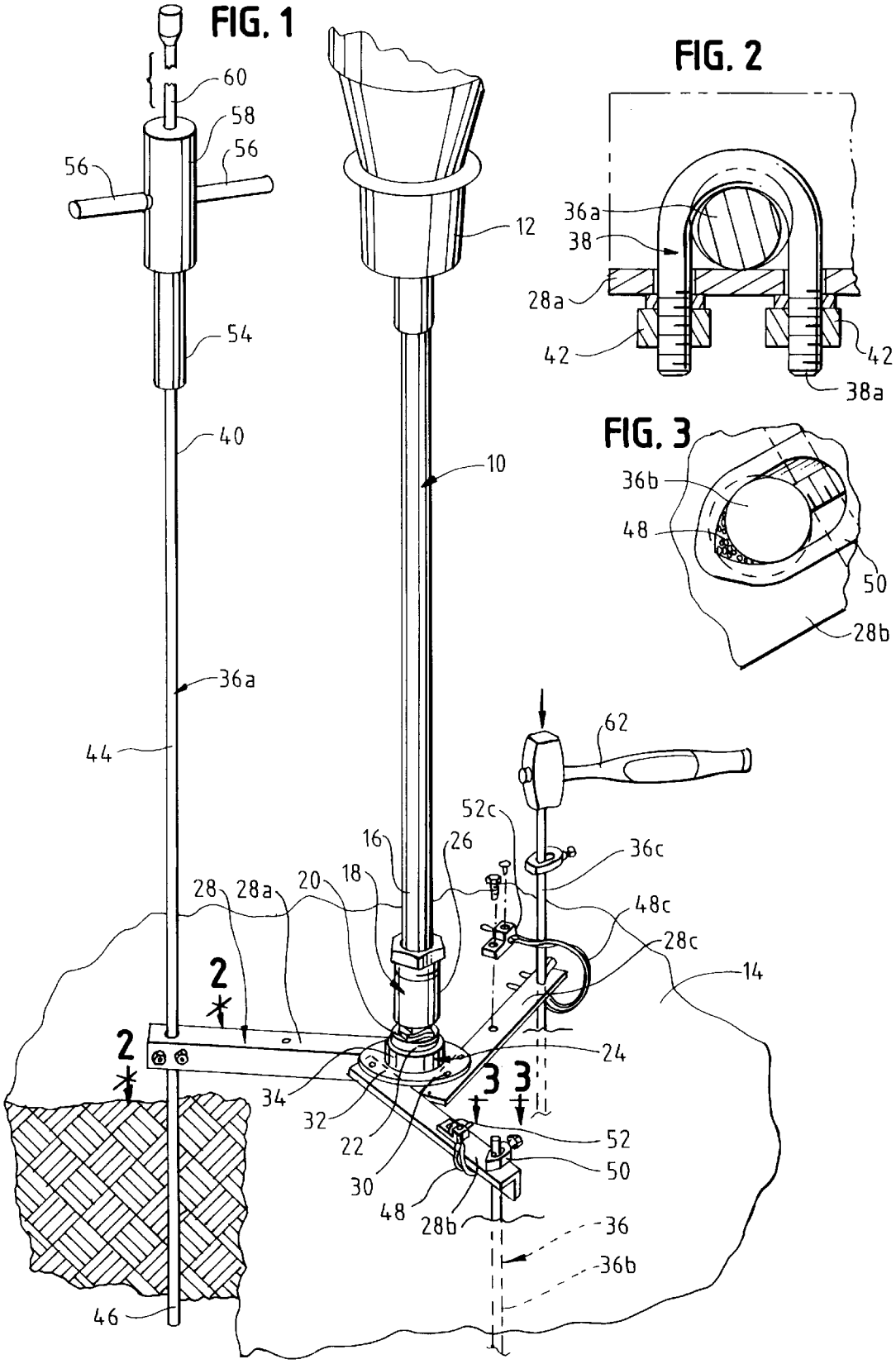
FIG. 1 is a perspective view, partially exploded and partially broken away, of the present invention embodied in a base holding an electrical fixture in an upright position and having its outlying portions in different stages of being staked to and electrically grounded in an earthen site.
FIG. 2 is an enlarged sectional view of a U-bolt clamp about to be tightened about a portion of a ground rod taken along line 2—2 in FIG. 1.
FIG. 3 is an enlarged sectional view of a portion of an acorn clamp disposed about a ground rod and cable taken along line 3—3 in FIG. 1.

In FIG. 1 a support member 10 holds an electrical fixture 12 above an earthen site 14. The fixture shown is an airport runway approach light, but it may be an edgelight beside a runway or taxiway, a directional sign, or some other form of electrical fixture. The lower end 16 of the support member 14 is engaged in a frangible coupling 18 which incorporates a breakable section 20 adjacent to a lower extremity 22 threadably engaged in a collar member 24. Breakable section 20 normally forms a rigid link between the upper portion 26 of the frangible coupling holding the lower end 16 of the support member and the lower extremity 22 of the frangible coupling, but breakable section 20 is made with a predetermined breaking point so that when a plane wing or tire or some other type of vehicle strikes the fixture, or its support member, the breakable section will break first and not interfere with the vehicle.

As shown in FIG. 1, collar member 24 is mounted on a flange member 28 by fastening the bolts 30 through a lower, horizontally disposed end 32 of the collar member 24 and corresponding holes (not shown) in the flange member 28. The flange member 28 supports a first end 34 of the collar member in an upright position for receiving the lower extremity 22 of the frangible coupling 18. The collar member 24 will easily be recognized as a standard pipe flange which can be obtained readily from plumbing and building supply sources.

Figure 11:
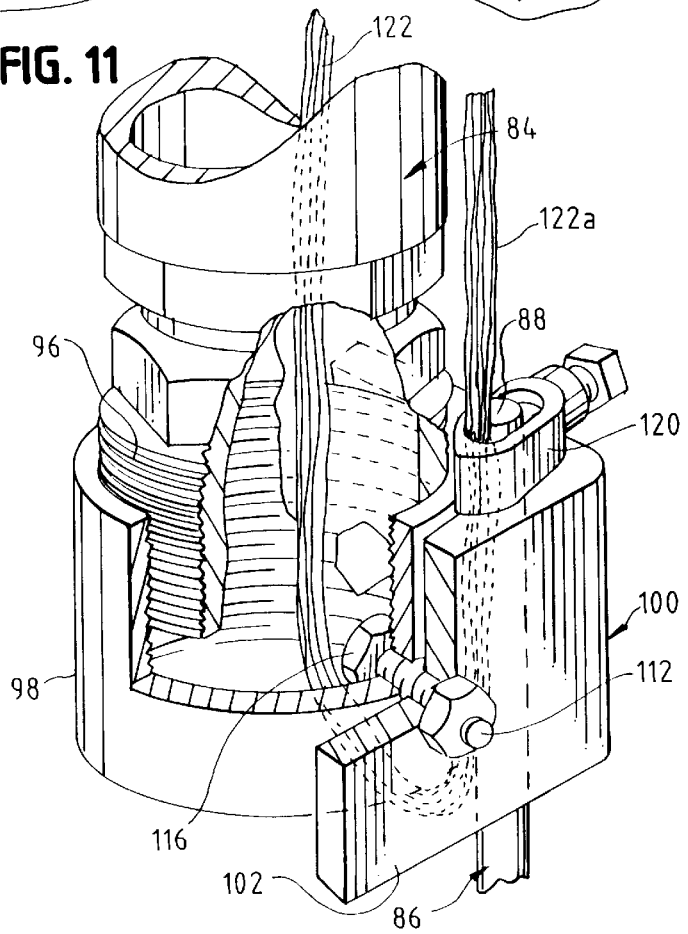
FIG. 11 is an enlarged perspective view, partially broken away, of a portion of the embodiment in FIG. 10 showing an end of the ground rod and an extension of a portion of the cable clamped against the end of the ground rod and forming the lightning rod shown in FIG. 10.

Alternatively, however, the lower, horizontally disposed end of collar 24 may be omitted and the entire collar 24, including first end 34 may take the form of a straight-sided sleeve (see 98 in FIG. 11). In the three-legged configuration of flange member 28 shown in FIG. 1, the entire straight-sided sleeve may be nested into the junction of legs 28*a*, 28*b* and 28*c* and fastened there by means such as welding. In that alternative form, the legs 28*a*, 28*b* and 28*c* still hold the first end 34 in an upright position for receiving the lower extremity 22 of frangible coupling 18.

At an outer end of at least one of the legs 28*a*, 28*b* and 28*c* an elongated ground rod dowel member 36 is fastened to the leg, preferably by an adjustable fastening means such as the U-bolt assembly 38 shown in FIG. 2 arranged about ground dowel member rod 36*a*. In that assembly, the yoke of U-bolt 38*a* is placed around ground rod 36*a*, and the legs of the U-bolt are placed through apertures in the side of flange member leg 28*a*. When ground rod dowel member 36*a* is driven far enough into the ground so that it is positioned with its first end portion 40 adjacent the flange member leg 28*a*

(shortly to be described), nuts 42 on the legs of U-bolt 38*a* are tightened, bringing the yoke portion of U-bolt 38*a* into firm, electrical contact with the ground rod dowel member 36*a* and joining the ground rod dowel member to the collar member 24 by means of the flange member leg 28*a*.

Each ground rod dowel member 36 is at least eight feet long and at least five-eighths inches in diameter, as the National Electrical Code must have eight feet of length in contact with the soil at the site 14. Preferably each ground rod dowel member is ten feet long, which allows enough length to insure that sufficient surface area of the rod is in contact with the soil and that there is enough length above the surface for attachment to the flange member 28. The effective surface of the soil can also be raised by covering the top end of each ground rod dowel with gravel to ensure satisfying the National Electrical Code. The ground rod dowel member 36*a*, for example, has a first end portion 40 available above ground when it is fully driven into the earthen site 14 for attachment to leg 28*a* and a body portion 44 and a second end portion 46 positionable deeply in the soil at the earthen site 14 for transmitting and discharging electrical charges from the fixture 12 and support means 10 into the earth.

A supplementary electrical grounding cable 48 may also be used to insure the connection of the ground rod to the flange member. One end of cable 48 is joined to the first portion of a ground rod dowel member, such as 36*b*, as shown in FIG. 1, and an opposite end of cable 48 is joined to the leg 28*b*. An enlarged view of a connection of the cable to the ground rod dowel member is shown in FIG. 3. An acorn clamp 50 is disposed about the rod 36*b* and one end of cable 48 is clamped against rod 36*b* by clamp 50. The other end of cable 48 is engaged in clamp 52 on flange member leg 28*b*. An exploded view of a similar cable connection is cable 48*c* and clamp 52*c* on flange member leg 28*c*. Preferably, the cable is a No. 6, seven copper wire stranded cable.

As illustrated in FIG. 1, the legs 28*a*, 28*b* and 28*c* of flange member 28 normally lie in a substantially horizontal plane on the surface of the earth at the site 14. They radiate outwardly from a centrally located junction, with first end portions at the outer ends which are connected to the elongated ground rod dowel members 36*a*, 36*b* and 36*c*, respectively. The collar member 24, as described above, is joined to the leg portions at a point spaced apart from the first end portions, preferably at the centrally located junction of the leg portions in the illustrated embodiment. The first end portions of the legs are apertured to permit passage of the ground rod members therethrough, and when a site 14 is located, the leg and collar assembly is placed thereon and the ground rod members driven into the ground. Sometimes it is desirable to remove a shovel full of dirt to level the ground first. The ends of the rods are placed through the apertures at the outer ends of the legs and also through the U-bolt assemblies 38. The rods may be started by using a device called a RAMROD driver, shown in position on ground rod 36*a* in FIG. 1. A sleeve 54 of the driver is fitted over the first end portion 40 of ground rod 36*a*. The handles 56 of the driver are manipulated to raise and lower a weighted slide 58 which moves along a guide rod 60. One person can raise the slide 58 along the guide rod 60 and then let the slide fall on the end of the sleeve 54. When the ground rod 36*a* is driven far enough into the ground with the RAMROD device, it can be driven the rest of the way with a well-weighted hammer, such as hammer 62, also shown in FIG. 1.

Figure 4:
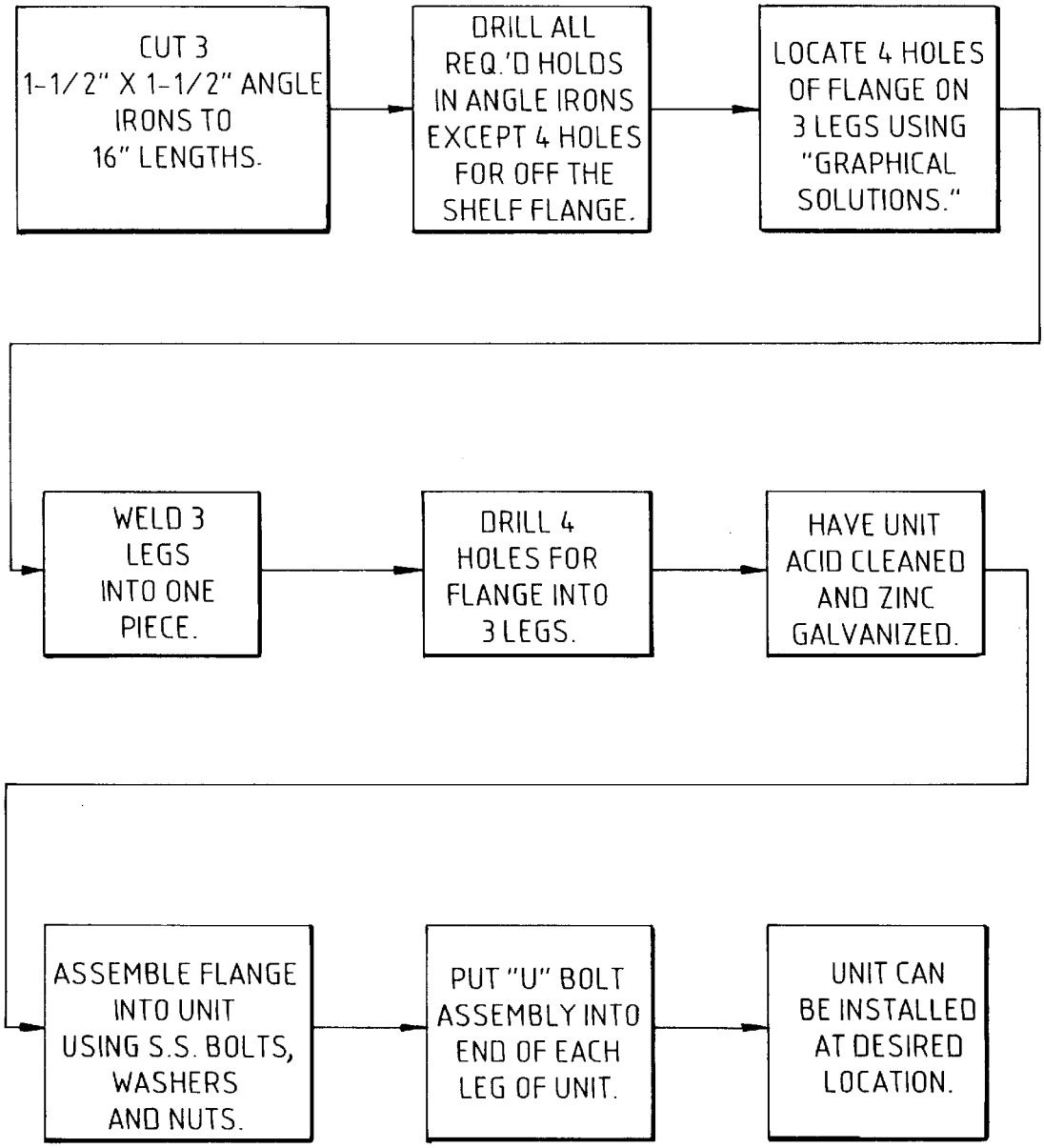
FIG. 4 is a flow diagram describing the steps of forming the three-legged base shown in FIG. 1.
Figure 5:
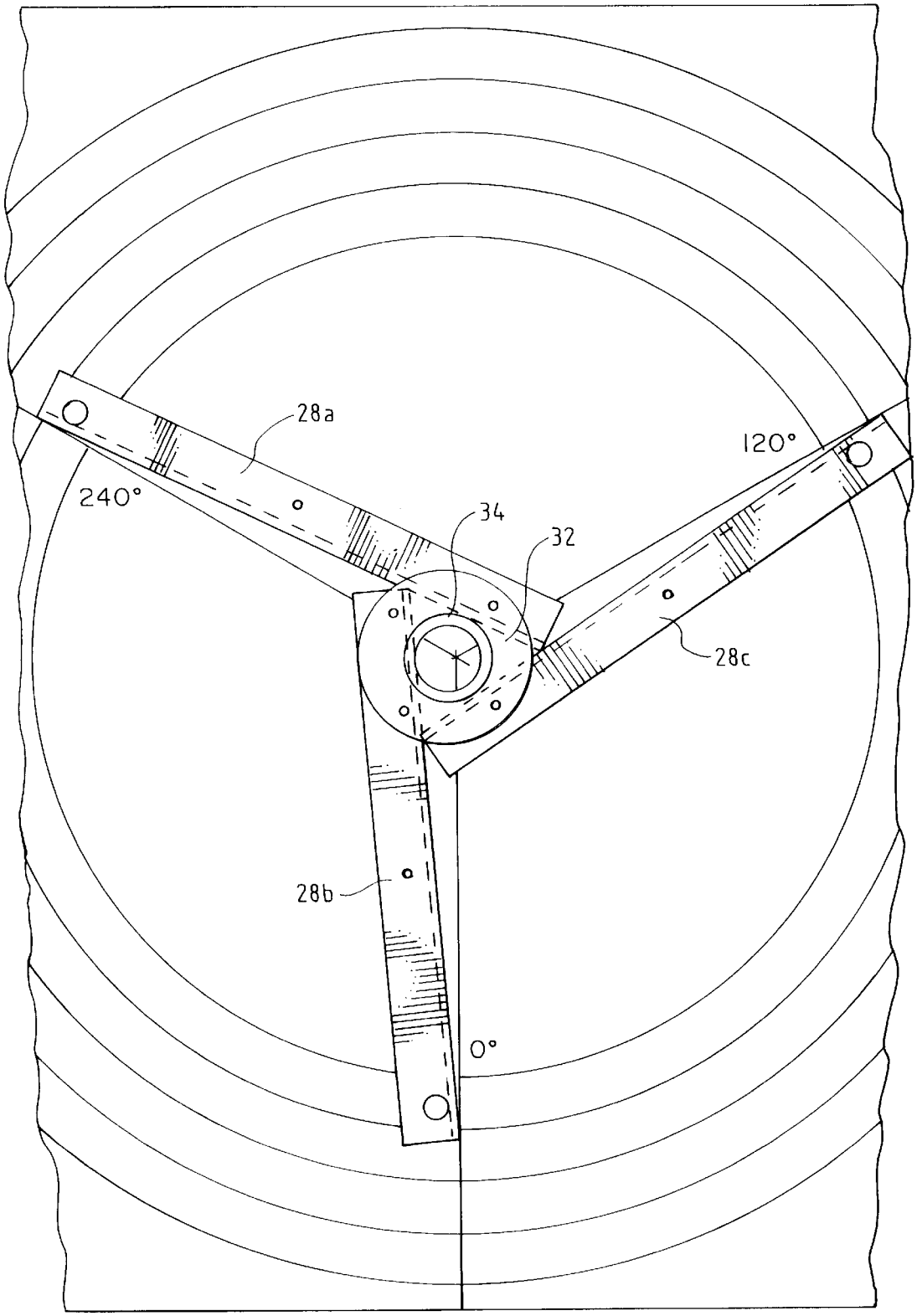
FIG. 5 is a diagram describing the angular assembly of the three-legged base shown in FIG. 1.

The assembly of the base for the fixture which is shown in FIG. 1 may be constructed in accordance with the steps diagramed in FIG. 4. As described there, three pieces of angle iron one and one-half inches by one and one-half inches may be cut to sixteen inch lengths for legs 28*a*, 28*b* and 28*c*. Holes for the ground rod members 36*a*, 36*b* and 36*c* may be bored at an outer end of each length of angle iron, as may the holes for U-bolts 38*a*, 38*b* and 38*c* and for clamps 52 to be fastened onto the angle iron lengths. Using the angular disposition of the angle iron lengths shown in FIG. 5, four holes may be located on the inner ends of the angle iron lengths which are to be joined together in a centrally located junction. Next the angle iron lengths may be welded into a single unit, with the welds preferably being at two separate points on each angle iron length adjacent the inner ends of the angle iron lengths and the upper faces of these lengths being arranged to accept a horizontally disposed flared end of a standard pipe flange. The outer ends of the angle iron lengths are spaced apart one hundred twenty degrees from each other.

After the angle iron lengths (legs 28*a*, 28*b* and 28*c*) are welded together, the holes for securing the pipe flange to the legs are drilled. The assembled legs can be treated for electrical conductivity, as by acid cleaning and galvanization, and the pipe flange assembled thereto using stainless steel bolts and nuts. The U-bolt assemblies 38 may be attached, and the base is then ready for installation at any desired location.

It is desirable that the leg portions 28*a*, 28*b* and 28*c* over-converge, not only for strength at the central junction, but also to provide a centrally located aperture for an electrical cable to be brought up from the ground and through the support member 10 to the fixture 12. Normally, too, the central aperture for the pipe flange type of collar member 24 includes a tapered inner thread into which a cooperatively tapered outer thread on the outer surface of the lower extremity 22 of the frangible coupling 18 can be inserted securely in a zero-tolerance fit to prevent wobbling of the frangible coupling 18 and of the support member 10.

Figure 6:
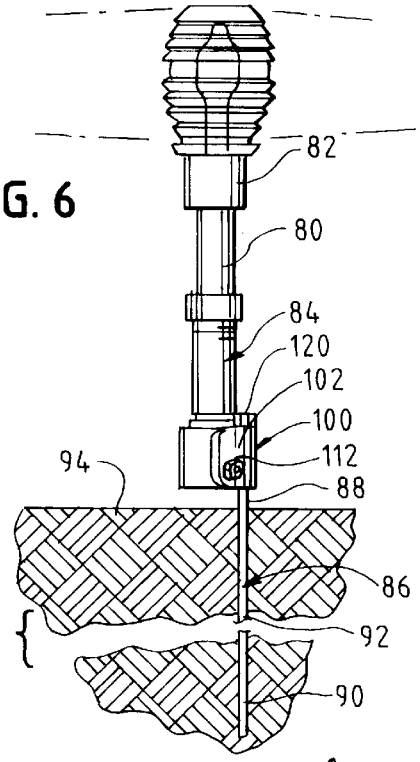
FIG. 6 is an elevational view, partially in section, of an alternative embodiment of the present invention embodied in a base holding an electrical fixture in an upright position and utilizing a single ground rod for electrically grounding the fixture and base at an earthen site.
Figure 8:
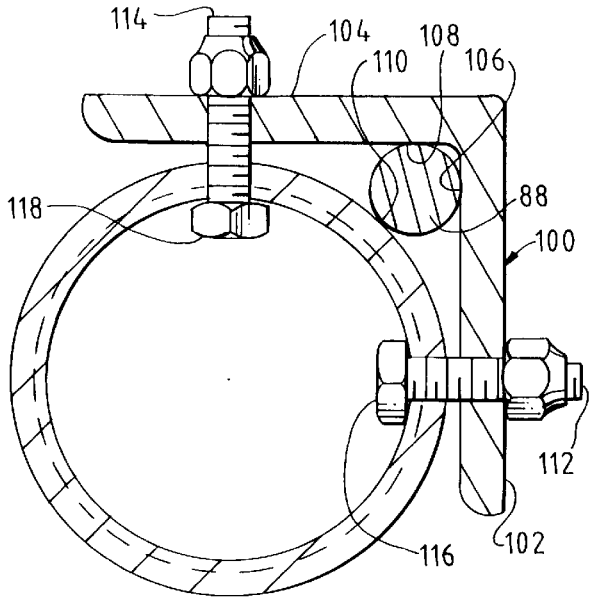
FIG. 8 is a sectional view of the base shown in FIG. 7 taken along the line 8—8 in FIG. 7.
Figure 7:
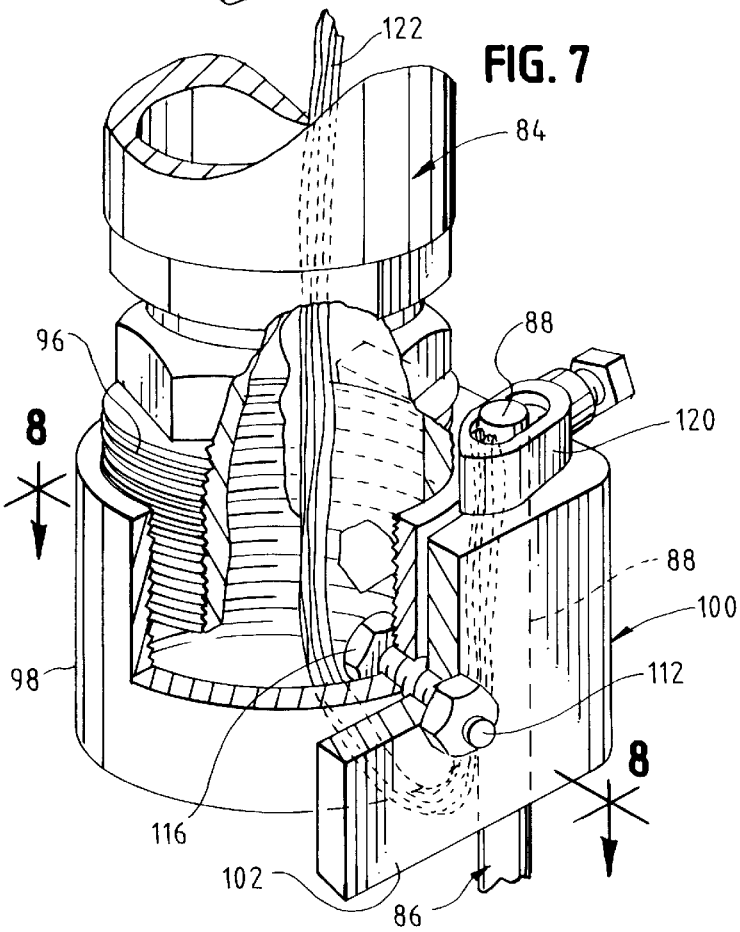
FIG. 7 is an enlarged perspective view, partially broken away, of an end of the ground rod shown in FIG. 6 assembled with elements of the base for mounting and grounding the fixture shown in FIG. 6.

An alternative embodiment of the present invention is shown in FIGS. 6 through 8. The same form of support member for an electrical fixture is used, as well as the frangible coupling and the sleeve having no horizontally disposed lower end. A somewhat different electrical fixture is illustrated, but a variety of fixtures may be used in either embodiment. The same form of elongated dowel rod member is used, but the specific manner of connecting it to the frangible coupling differs.

Accordingly, in FIGS. 6 through 8, a support member 80 having an electrical fixture 82 on its upper end is illustrated having its lower end mounted in a frangible coupling 84. The fixture 82 and support member 80 are connected to an elongated ground rod dowel member 86 having a first end portion 88, a second end portion 90 and a body portion 92. The second end portion and the body portion of the ground rod member 86 are buried deeply within an earthen site 94 for transmitting and discharging electrical charges from the fixture and support member into the earth.

The fixture 82 and support member 80 are connected to ground rod 86 in the following manner. The lower extremity 96 of the frangible coupling 84 is threadably engaged upon a sleeve 98, the outside surface of which is adapted to make a firm electrical contact with the first end portion 88 of rod 86. A flange member 100 clamps the first end portion 88 of the rod 86 against the side of sleeve 98, utilizing at least one plate portion 102. A second plate portion 104 may also be employed, joined at an angle to the plate portion 102 so that the first end portion 88 of rod 86 is collected at the junction of plate portions 102 and 104 and held at two separate points, 106 and 108, while being clamped against the side of sleeve 98 at a third point 110. Plate portions 102 and 104 are clamped against sleeve 98 by bolts 112 and 114, respectively. The heads 116 and 118 of bolts 112 and 114, respectively, because they extend inwardly inside sleeve 98, also serve as stops for the lower extremity 96 of frangible coupling 84 to abut.

An acorn clamp 120, as shown in FIG. 7, is utilized on the first end portion 88 of ground rod 86 for clamping the end of a grounding cable 122 to ground rod 86. As was the case with the first embodiment of the present invention, above described, cable 122 is preferably a length of No. 6 seven strand copper wire cable, which meets the standards prescribed by the National Electrical Code for this purpose. The other end of cable 122 (not shown) is connected to electrical fixture 82 so that electrical charges in the fixture can be transmitted to the ground rod member 86 and safely discharged into the ground at the earthen site 94.

Figure 10:
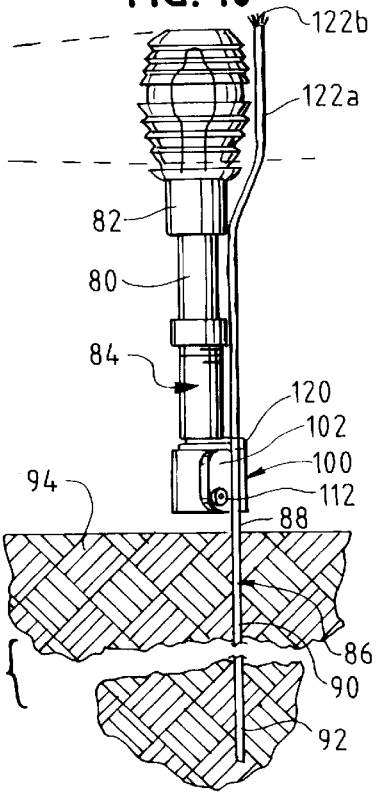
FIG. 10 is an elevational view, partially in section, of a further alternative embodiment of the present invention incorporating a lightning rod adjacent to the fixture.

As shown in FIGS. 10 and 11, the embodiment of the present invention just described may be further provided with a lightning rod 122*a* by extending the cable 122 above the acorn clamp 120 to a point just above fixture 82. The upper, distal end 122*b* of lightning rod 122*a* is splayed into a set of prongs by fanning out the copper strands of the cable. Electrical charges in the atmosphere adjacent the fixture 82 will be transmitted along lightning rod 122*a*, probably even in preference to traveling along the fixture 82 and cable 122, to the ground rod 86 to be discharged into the ground of the earthen site 94.

Figure 9:
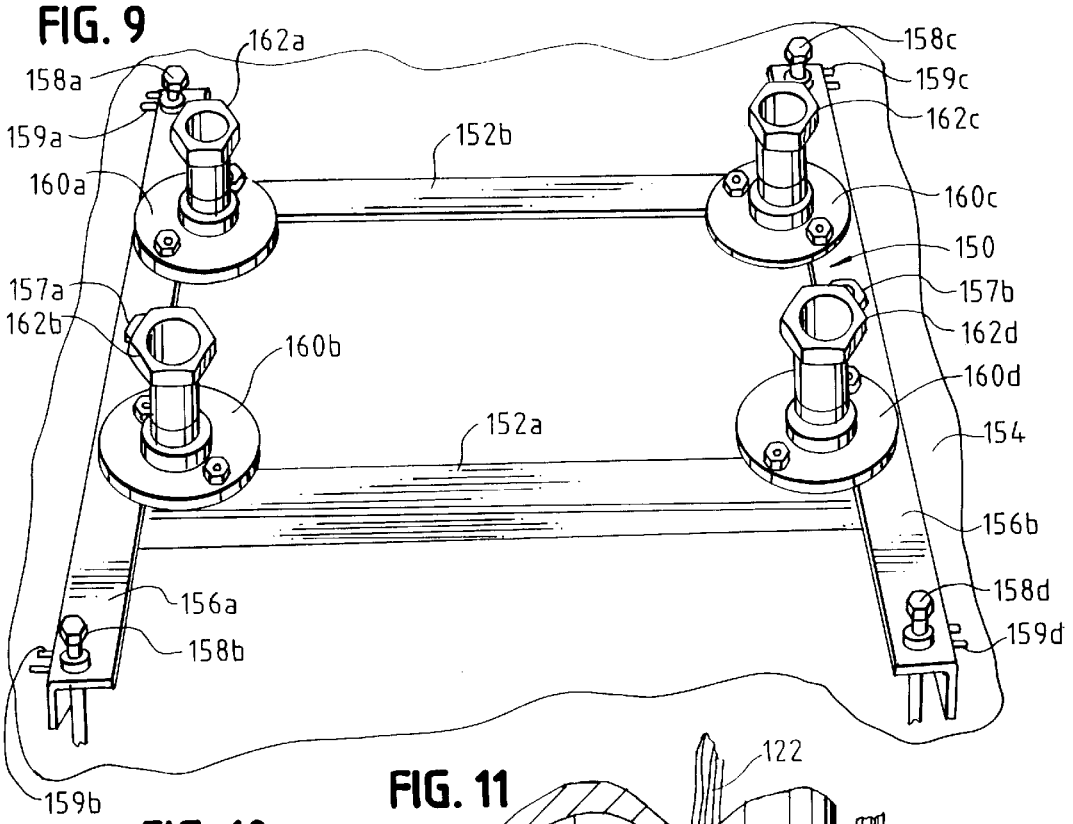
FIG. 9 is a perspective view of a further alternative embodiment of the present invention embodied in a base for holding an electrical fixture in an upright position at an earthen site and incorporating a plurality of electrical ground rods.

A further modified form of the flange member in the present invention is shown in FIG. 9. In this modification the flange member 150 includes a plurality of leg portions adapted to lie in a substantially horizontal plane on the surface of the earth at the site where the fixture is to be located, and a plurality of collar members are affixed to the leg portions. The collar members may be adapted to accept frangible couplings into which support means (not shown) for one or more electrical fixtures (also not shown) are inserted. The fixture, or fixtures, are positioned on the support means above the leg portions. As illustrated in FIG. 9, leg portions 152*a* and 152*b* are arranged substantially parallel to each other in a horizontal plane in an earthen site 154. Leg portions 156*a* and 156*b* of the flange member 150 are also arranged to be substantially parallel to each other at opposite ends of and approximately normal to leg portions 152*a* and 152*b*.

Ground rod dowel members 158*a*, 158*b*, 158*c* and 158*d*, driven into the earth at the site, and grasped by U-bolts 159*a*, 159*b*, 159*c* and 159*d* as described above, hold the flange member 150 securely in place. Collar members 160*a*, 160*b*, 160*c* and 160*d* are bolted to the leg portions 152*a–b* and 156*a–b*, preferably at their intersections as shown, and frangible couplings 162*a*, 162*b*, 162*c* and 162*d* are threadably assembled in the upright ends of those collar members. If, for some reason, an assembler would not wish to use a frangible coupling type of connection, a support member could be directly installed in the collar member, but for safety reasons normally the frangible coupling assembly arrangement which is illustrated would be used. Also, if desired, one or more of the leg portions such as 156*a* and 156*b* may be provided with apertures such as those shown at 157*a* and 157*b*, respectively, and optional conduit fittings (not shown) may be arranged therein for electrical grounding engagement upon the said leg portions.

While particular embodiments of the present invention have been shown, it will be understood, of course, that the invention is not limited thereto since modifications may be made by those skilled in the art, particularly in light of the foregoing teachings. For example, the manner of mounting and grounding hereinabove described may be used with fixtures which may become incidentally electrified such as barbecue grills, play equipment in yards, and flag poles. It is, therefore, contemplated by the appended claims to cover any such modifications as incorporate those features which come within the true spirit and scope of the invention.

I claim:

1. A base for mounting and grounding an electrical fixture in an earthen site comprising at least one collar member having a first end adapted to receive support means for an electrical fixture, a flange member engaging the collar member and supporting the first end of the collar member in an upright position, at least one elongated ground rod dowel member having a first end portion, a body portion and a second end portion, the first end portion being joined to the collar member by the flange member, and the second end portion and the body portion being positioned deeply within the earth at the site for transmitting and discharging electrical charges from the fixture and support means into the earth.

2. The base of claim 1 in which the flange member includes at least one leg portion adapted to lie in a substantially horizontal plane on the surface of the earth at the site, the first end portion of the ground rod dowel member being joined to a first end of the leg portion, and the collar member being joined to the leg portion at a point spaced apart from the first end of the leg portion.

3. The base of claim 2 in which an electrical grounding cable is joined to the first end portion of the ground rod dowel member and extends therefrom to a junction of the said cable to the leg portion spaced apart from the first end portion of the ground rod dowel member.

4. The base of claim 3 in which the flange member includes a plurality of leg portions arranged to radiate in a substantially horizontal plane from a centrally located junction, and the collar member is connected to the leg portions at the centrally located junction.

5. The base of claim 4 in which the collar member comprises a sleeve having outside surface areas joined to the leg portions of the flange member at the centrally located junction of the leg portions.

6. The base of claim 4 in which the collar member includes a foot portion fixed upon the leg portion of the flange member and a neck portion above the leg portion of the flange member for receiving and engaging the support means for the electrical fixture.

7. The base of claim 2 in which the first end portion of the ground rod dowel member is joined to the first end of the leg portion with a clamp member engaging and repositionable upon the ground rod dowel member.

8. The base of claim 1 in which the flange member includes a plurality of leg portions adapted to lie in a substantially horizontal plane on the surface of the earth at the site, and a plurality of collar members affixed to the leg portions adapted to receive support means for an electrical fixture positioned on the support means above the leg portions.

9. The base of claim 1 which includes an electrical grounding cable extending from the fixture to the first end portion of the ground rod dowel member.

10. The base of claim 9 which includes an electrical clamp holding the electrical grounding cable to the first end portion of the ground rod dowel member.

11. The base of claim 1 in which the flange member includes at least one plate portion disposed upon the collar member, and the first end portion of the ground rod dowel member is clamped against the collar by the plate portion of the flange member.

12. The base of claim 11 which includes a frangible coupling member intermediate the support means and the collar member having a socket end adapted to be engaged by a leg member supporting the fixture, a second end engaged in the collar member opposite the socket end, and a frangible portion intermediate the socket end and the second end.

13. The base of claim 11 which includes a flange member having plate portions intersecting each other and connecting the first end portion of the ground rod dowel member to the collar member.

14. The base of claim 11 which includes a lightning rod member extending from the first end portion of the ground rod dowel member along side the support means to a distal end of the lightning rod member adjacent the electrical fixture.

15. The base of claim 14 in which the lightning rod member is an extended portion of an electrical grounding cable.

16. A base for mounting and grounding a fixture which may become incidentally electrified by coming in contact with an electrical circuit or with an electrical charge in an earthen site comprising at least one collar member having a first end adapted to receive support means for an electrical fixture, a flange member engaging the collar member and supporting the first end of the collar member in an upright position, at least one elongated ground rod dowel member having a first end portion, a body portion and a second end portion, the first end portion being joined to the collar member by the flange member, and the second end portion and the body portion being positioned deeply within the earth at the site for transmitting and discharging electrical charges from the fixture and support means into the earth.

* * * * *